US010160526B2

(12) United States Patent
Scott

(10) Patent No.: US 10,160,526 B2
(45) Date of Patent: Dec. 25, 2018

(54) INFLATABLE PERSONAL FLOATATION SYSTEMS

(71) Applicant: Eric Scott, Richmond (CA)

(72) Inventor: Eric Scott, Richmond (CA)

( * ) Notice: Subject to any disclaimer, the term of this patent is extended or adjusted under 35 U.S.C. 154(b) by 0 days.

(21) Appl. No.: 15/594,405

(22) Filed: May 12, 2017

(65) Prior Publication Data

US 2018/0327062 A1 Nov. 15, 2018

(51) Int. Cl.

| | |
|---|---|
| ***B63C 9/125*** | (2006.01) |
| ***B63C 9/15*** | (2006.01) |
| *B63C 9/00* | (2006.01) |

(52) U.S. Cl.

CPC ..... *B63C 9/155* (2013.01); *B63C 9/1255* (2013.01); *B63C 2009/007* (2013.01)

(58) Field of Classification Search

CPC ..... B63C 9/155; B63C 9/1055; B63C 9/1255; B63C 2009/007

See application file for complete search history.

(56) References Cited

U.S. PATENT DOCUMENTS

| | | | | |
|---|---|---|---|---|
| 2,547,333 | A * | 4/1951 | Lund | B63C 9/1255 441/123 |
| 2,753,574 | A * | 7/1956 | Wolshin | B63C 9/155 441/94 |
| 4,498,882 | A | 2/1985 | Evert | |
| 4,793,575 | A | 12/1988 | Butler | |
| 5,466,179 | A * | 11/1995 | Jeffrey, Sr. | B63C 9/155 441/108 |
| 5,820,431 | A * | 10/1998 | Biesecker | B63C 9/1255 441/94 |
| 6,551,159 | B1 * | 4/2003 | Spinelli | B60R 21/00 441/80 |
| 7,128,629 | B2 | 2/2006 | Summers | |
| 8,979,605 | B2 * | 3/2015 | Senn | B63C 9/155 441/92 |
| 9,017,126 | B2 | 4/2015 | Newmann | |
| 9,139,267 | B2 | 9/2015 | Zablocki | |
| 9,205,900 | B2 | 12/2015 | Tatum | |
| 9,227,706 | B2 | 1/2016 | Darroch | |
| 9,371,119 | B2 | 6/2016 | Malcom | |
| 9,457,878 | B1 | 10/2016 | Schultz | |
| 2015/0197323 | A1 | 7/2015 | Cerdas | |
| 2016/0304177 | A1 | 10/2016 | Skipworth | |

* cited by examiner

*Primary Examiner* — Andrew Polay

(74) *Attorney, Agent, or Firm* — Integrity Patent Group, PLC; Charles E. Runyan

(57) ABSTRACT

An inflatable personal floatation systems includes the manually inflated personal floatation device for aviation use including arm-strap loops, an inflation pull cord, a pack breakaway tether, and an inflation canister, a sealed pouch, an individual floatation device pack and a strap. The individual floatation device is configured to be worn in a waist belt. The individual floatation device is housed within the sealed pouch and connected to the sealed pouch via the pack breakaway tether. The inflatable personal floatation system provides a safety device for the user-wearer.

20 Claims, 5 Drawing Sheets

INFLATABLE PERSONAL FLOATATION SYSTEMS

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. FIELD OF THE INVENTION

The present invention relates generally to the field of floatation devices and more specifically relates to inflatable personal floatation systems.

2. DESCRIPTION OF RELATED ART

Over the years various life vests or personal floatation devices have been developed for keeping a wearer afloat in a body of water during recreational activities and in emergencies. Personal floatation devices are required to be aboard the vast majority of general aviation aircraft for safety purposes. The requirement to carry survival equipment for operations over water more than 50 miles from land set out in FAR 91.509 applies to airplanes weighing over 12,500 pounds and turbojets. In the event of an emergency, having personal flotation devices for each person aboard an airplane flying over water is sensible. Current aviation certified devices are keyhole bladder design units that are permanently fixed to a waist belt. If the bladder is inflated at the wrong time a user-wearer may be trapped inside. A suitable solution is desired for safety.

U.S. Pat. No. 9,205,900 to Donnie Franklin Tatum relates to a harness assembly having a deployable inflatable life raft attached thereto. The described harness assembly has a deployable inflatable life raft attached thereto. The harness assembly has a pouch attached thereto for storage of a manually deployable life raft. The harness assembly is comprised of a waist strap of sufficient length to reach around the mid-section of a human body and a back, frontal left, and frontal right panel sections integrally joined with one another forming a life vest. The frontal left and right panel sections include a fastener for coupling together to form a neck opening. The pouch is removably attached to the harness assembly and positioned thereinbetween the waist strap and life vest. The inflatable life raft is disposed of within the pouch in a deflated state. The life raft includes an elongated tether cord having a first end attached to the life vest and a second end attached to the life raft. The life raft is adapted to be inflated when, in an emergency situation, the raft is removed from the pouch.

BRIEF SUMMARY OF THE INVENTION

In view of the foregoing disadvantages inherent in the known floatation device art, the present disclosure provides a novel inflatable personal floatation system. The general purpose of the present disclosure, which will be described subsequently in greater detail, is to provide a manually inflated personal floatation device for aviation use. The device may be used in other applications.

An inflatable personal floatation system is disclosed herein. The inflatable personal floatation system includes an individual floatation device having arm-strap loops, an inflation pull cord, a pack breakaway tether, and an inflation canister, a sealed pouch, an individual floatation device pack and at least one strap. The inflatable personal floatation system comprises the individual floatation device, the sealed pouch, the individual floatation device pack, and the strap structured and arranged in functional combination to provide a floatation device for emergency use.

The individual floatation device in preferred embodiments comprises two arm-strap loops, the inflation pull cord, the pack breakaway tether, and the inflation canister. The individual floatation device may comprise a substantially u-shaped device. Other shapes may be used in alternate embodiments. The individual floatation device is configured as a detachable u-shaped bladder housed in the sealed pouch within the individual floatation device pack. The individual floatation device pack is configured to be worn by a user-wearer in a waist belt configuration. The individual floatation device may be housed within the sealed pouch and connected to the sealed pouch via the pack breakaway tether. The u-shaped bladder is not permanently fixed to the waist belt for safety. The breakaway tether is permanently connected inside the sealed pouch.

The sealed pouch is connected to an inside portion of the individual floatation device pack via the strap. The individual floatation device is manually inflatable. The u-shaped bladder is manually inflatable by an inflation canister (or other suitable means). The inflation pull cord, when pulled, activates the inflation canister. The inflation canister comprises a user activated carbon dioxide cylinder. The inflatable personal floatation system provides a safety device for the user-wearer.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an inflatable personal floatation system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a floatation device and more particularly to an inflatable personal floatation system as used to improve the safety of users.

Generally, the inflatable personal floatation system is designed for aviation or enclosed cabin uses. The unit is typically but not limited to be worn in a waist belt configuration. The device is configured as a u-shaped bladder housed in a sealed bag within the waist pack. It may be tethered to a user-wearer's waist belt using a detachable tether allowing the user to detach he/she from the bladder in the event of an emergency. The u-shaped bladder is inflated manually by a user activated $CO_2$ cylinder which provides a source of pressurized gas.

Activation of the unit requires the user to open the inflatable floatation device pack and tear open the sealed pouch inside. The user-wearer may then remove the bladder from the sealed pouch which will still be tethered to the waist belt, and activate the inflation mechanism once clear of the aircraft cabin or enclosed space. The present invention is a tethered u-shaped design having the ability to be detached from the user-wearer in the event that the bladder is inflated at the wrong time, allowing the user-wearer to be separated from the bladder and not trapped inside with it to promote safety. Those with ordinary skill in the art will now appreciate that upon reading this specification and by their understanding the art of personal floatation devices as described herein, methods of using personal floatation devices will be understood by those knowledgeable in such art.

Figure 1:
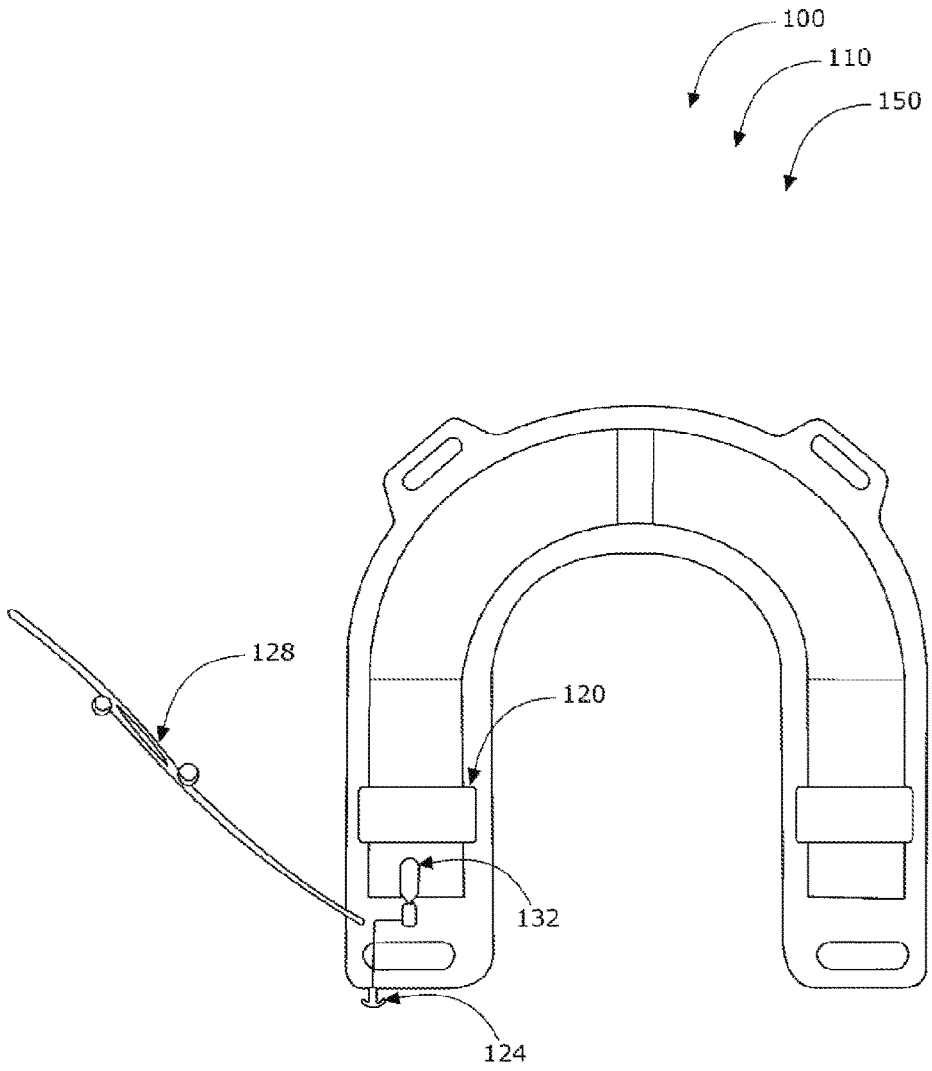
FIG. 1 is a perspective view of the inflatable personal floatation system including an individual floatation device, according to an embodiment of the disclosure.

Referring now more specifically to the drawings by numerals of reference, there is shown in FIGS. 1-5, various views of an inflatable personal floatation system 100. FIG. 1 is a perspective view of the inflatable personal floatation system 100 including an individual floatation device 110, according to an embodiment of the present disclosure. As illustrated, the inflatable personal floatation system 100 may include an individual floatation device 110 having arm-strap loops 120, an inflation pull cord 124, a pack breakaway tether 128, and an inflation canister 132, a sealed pouch 136, an individual floatation device pack 144 and a strap 148. The inflatable personal floatation system 100 may comprise the individual floatation device 110, the sealed pouch 136, the individual floatation device pack 144, and the strap 148 structured and arranged in functional combination.

Figure 2:
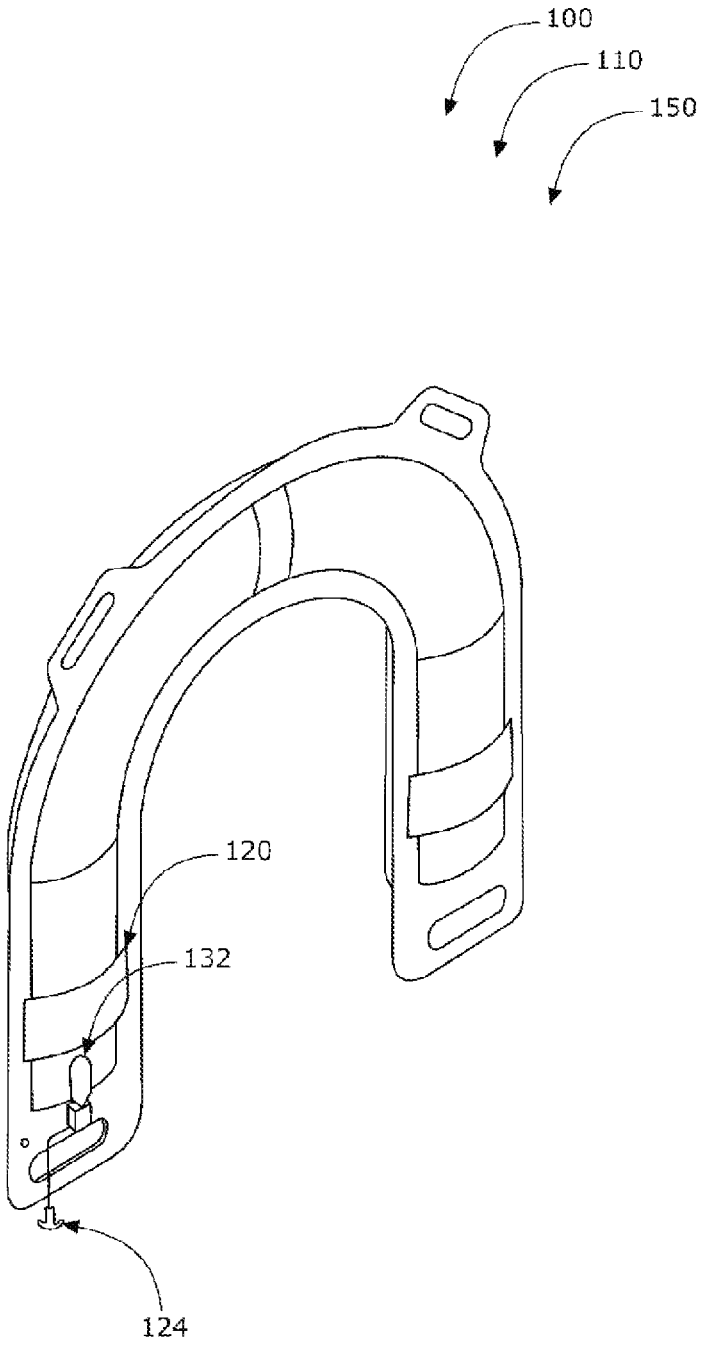
FIG. 2 is a perspective view of the inflatable personal floatation system of FIG. 1, according to an embodiment of the present disclosure.

Referring now to FIG. 2 showing a perspective view of the inflatable personal floatation system 100 of FIG. 1, according to an embodiment of the present disclosure. As above, the inflatable personal floatation system 100 may include an individual floatation device pack 144, a strap 148 and an individual floatation device 110 for providing a safety device for a user-wearer. The individual floatation device 110 comprises two arm-strap loops 120, the inflation pull cord 124, the pack breakaway tether 128, and the inflation canister 132. The individual floatation device 110 comprises a substantially u-shaped device. The individual floatation device 110 is configured as a detachable u-shaped bladder housed in the sealed pouch 136 within the individual floatation device pack 144.

The individual floatation device pack 144 is configured to be worn by a user-wearer. The individual floatation device 110 is configured to be worn in a waist belt configuration around a waist of a user-wearer. The individual floatation device 110 may be housed within the sealed pouch 136 and connected to the sealed pouch 136 via the pack breakaway tether 128. The individual floatation device 110 comprises the u-shaped bladder. The u-shaped bladder is not permanently fixed to the waist belt such that in the event that the bladder is inflated at the wrong time, allowing the user-wearer to be separated from the bladder and not trapped inside with it. The breakaway tether 128 may be permanently connected inside the sealed pouch 136.

Figure 3:
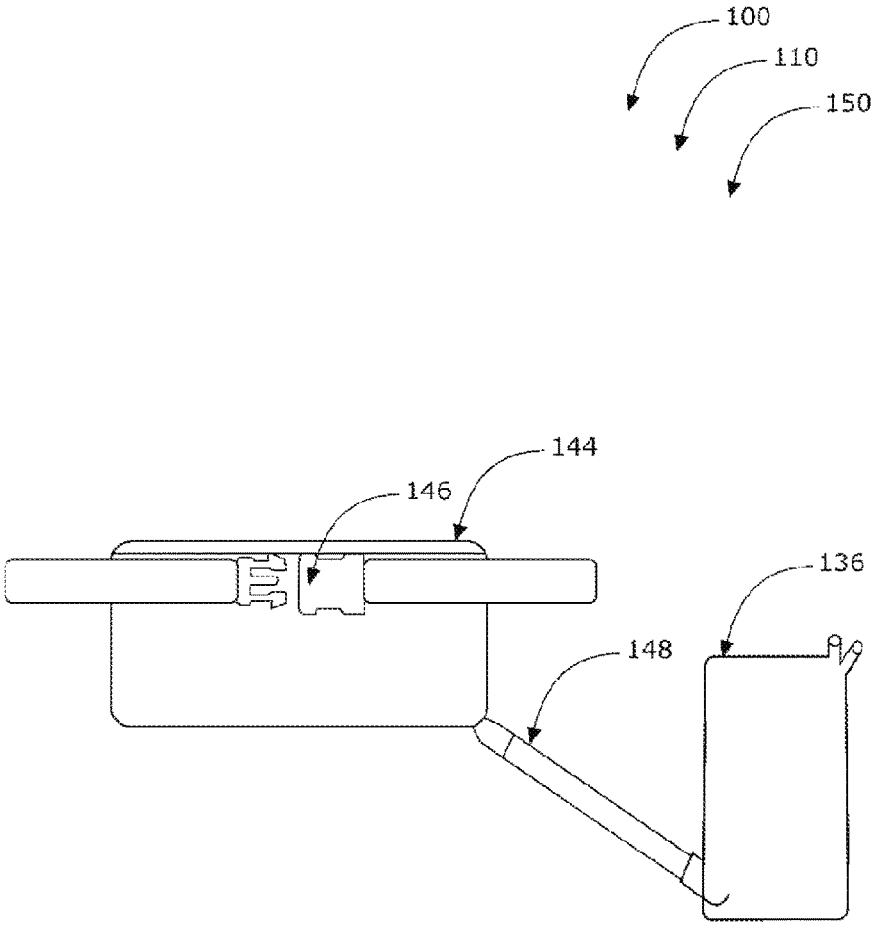
FIG. 3 is a perspective view of the inflatable personal floatation system of FIG. 1, having a sealed pouch, an individual floatation device pack, and a strap, according to an embodiment of the present disclosure.

FIG. 3 shows a perspective view of the inflatable personal floatation system 100 of FIG. 1, having a sealed pouch 136, an individual floatation device pack 144, and a strap 148, according to an embodiment of the present disclosure. As above, the inflatable personal floatation system 100 may include an individual floatation device pack 144, a strap 148 and an individual floatation device 110. The sealed pouch 136 may be connected to an inside portion of the individual floatation device pack 144 via the strap 148. The u-shaped bladder is manually inflatable by an inflation canister 132. The inflation pull cord 124, when pulled, activates the inflation canister 132. The inflation canister 132 comprises a user activated carbon dioxide cylinder. Alternate inflation means may be used.

In a preferred embodiment, carbon dioxide gas charge comprises 1 by 0.035 pounds (1×16 grams). An inflated volume of the individual floatation device 110 comprises a minimum of 970 cubic inches (16 liters). An inflated buoyancy comprises a minimum of 35 pounds (156 Newtons). The individual floatation device 110 supports the user-wearer weighing a minimum of 35 pounds. The device is configured to support an adult in a preferred embodiment. The individual floatation device 110 may comprise urethane coated nylon. The individual floatation device 110 comprises radio frequency heat sealed seams. The functional range of the device is up to 95% relative humidity and a storage range of up to 70% relative humidity. The inflatable personal floatation system 100 provides a safety device for the user-wearer. User-wearers may comprise virtually all sizes of individuals.

Figure 4:
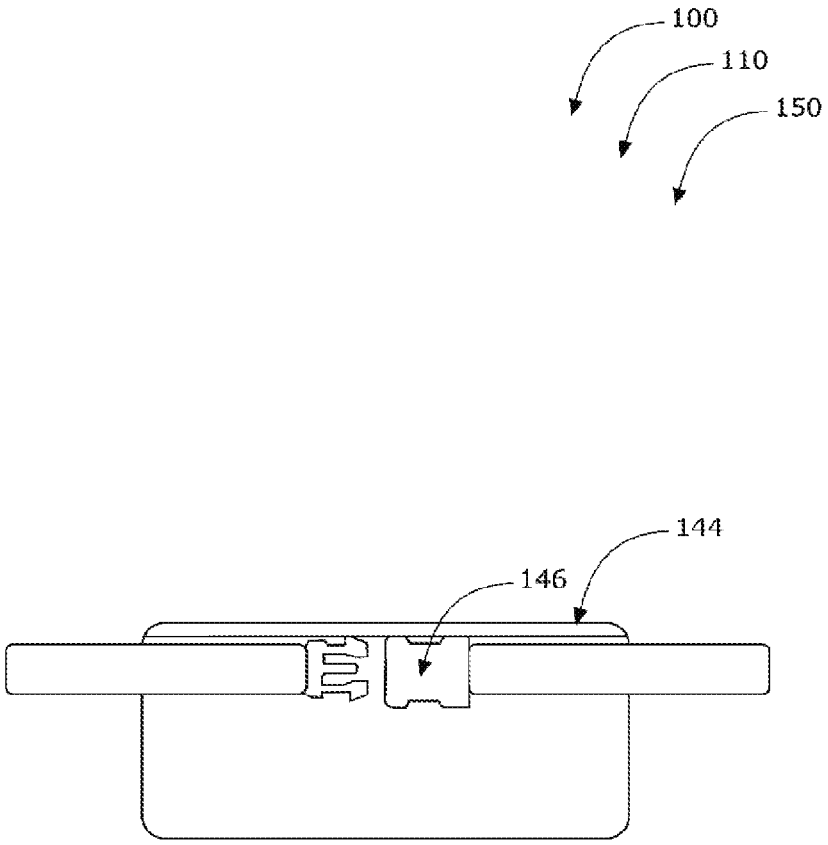
FIG. 4 is a perspective view of the individual floatation device pack of the inflatable personal floatation system of FIG. 1, according to an embodiment of the present disclosure.

FIG. 4 is a perspective view of the individual floatation device pack 144 of the inflatable personal floatation system 100 of FIG. 1, according to an embodiment of the present disclosure. As above, the inflatable personal floatation system 100 may include an individual floatation device pack 144 and a buckle 146 for fastening the individual floatation device pack 144 to a waist of a user-wearer. The individual floatation device 110 is configured as a detachable u-shaped bladder housed in the sealed pouch 136 within the individual floatation device pack 144. The individual floatation device pack 144 is configured to be worn by a user-wearer. The individual floatation device 110 is configured to be worn in a waist belt. The individual floatation device 110 is housed within the sealed pouch 136 and connected to the sealed pouch 136 via the pack breakaway tether 128.

Figure 5:
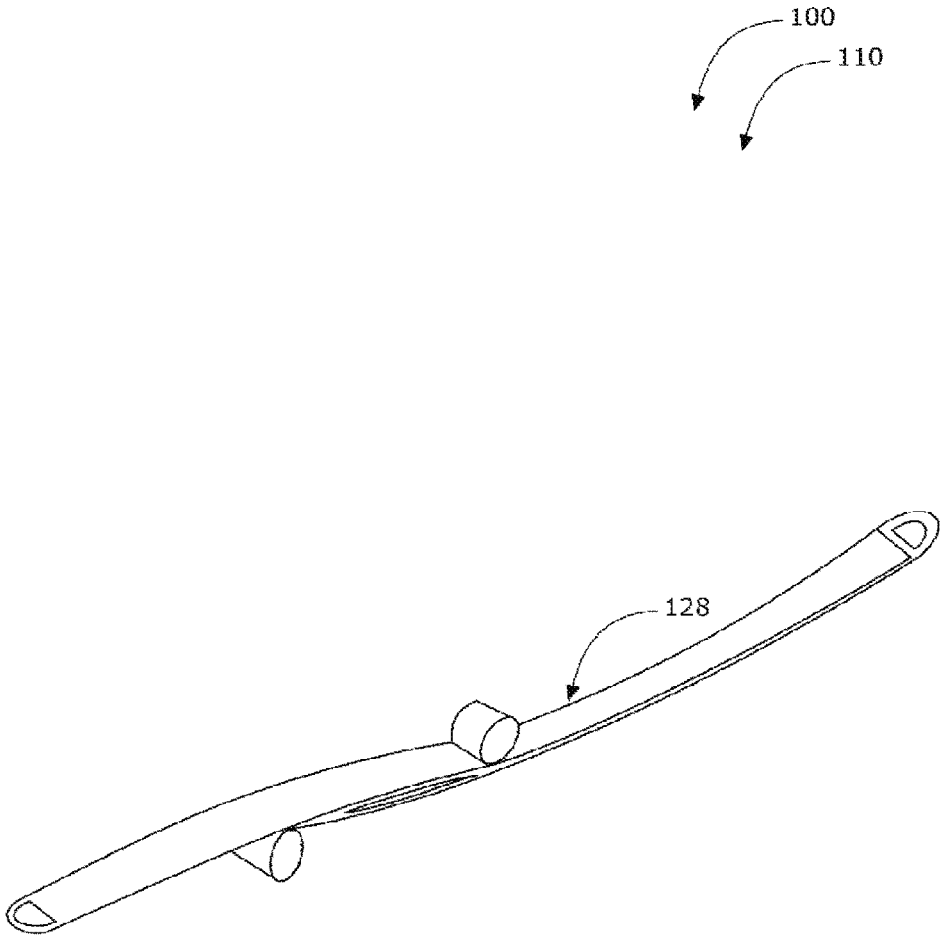
FIG. 5 is a perspective view of the inflatable personal floatation system of FIG. 1, according to an embodiment of the present disclosure.

FIG. 5 shows a perspective view of the inflatable personal floatation system 100 of FIG. 1, according to an embodiment of the present disclosure. As above, the inflatable personal floatation system 100 may include a pack breakaway tether 128. The pack breakaway tether 128 may be permanently affixed to an inside portion of the sealed pouch 136. In a preferred embodiment, the pack breakaway tether 128 comprises a hook-and-loop fastener section for separation. A separation point is preferably located in a center of the pack breakaway tether 128.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An inflatable personal floatation system comprising:
an individual floatation device having;
arm-strap loops;
an inflation pull cord;
a pack breakaway tether; and
an inflation canister;
a sealed pouch;
an individual floatation device pack; and
a strap;
wherein said inflatable personal floatation system comprises said individual floatation device, said sealed pouch, said individual floatation device pack, and said strap structured and arranged in functional combination;
wherein said individual floatation device comprises said arm-strap loops, said inflation pull cord, said pack breakaway tether, and said inflation canister;
wherein said individual floatation device is configured as a detachable u-shaped bladder housed in said sealed pouch within said individual floatation device pack;
wherein said individual floatation device pack is configured to be worn by a user;
wherein said individual floatation device is housed within said sealed pouch and connected to said sealed pouch via said pack breakaway tether;
wherein said sealed pouch is stored within said individual floatation device pack and connected to said individual floatation device pack via said strap;
wherein said inflation pull cord, when pulled, activates said inflation canister; and
wherein said inflatable personal floatation system provides a safety device for said user.

2. The inflatable personal floatation system of claim 1, wherein an inflated volume of said individual floatation device comprises a minimum of 970 cubic inches.

3. The inflatable personal floatation system of claim 1, wherein an inflated buoyancy comprises a minimum of 35 pounds.

4. The inflatable personal floatation system of claim 1, wherein said individual floatation device is manually inflatable.

5. The inflatable personal floatation system of claim 1, wherein said individual floatation device supports said user weighing a minimum of 35 pounds.

6. The inflatable personal floatation system of claim 1, wherein a carbon dioxide gas charge comprises 1 by 0.035 pounds.

7. The inflatable personal floatation system of claim 1, wherein said individual floatation device comprises urethane coated nylon.

8. The inflatable personal floatation system of claim 1, wherein said individual floatation device comprises radio frequency heat sealed seams.

9. The inflatable personal floatation system of claim 1, wherein said individual floatation device comprises a substantially u-shaped device.

10. The inflatable personal floatation system of claim 1, wherein said individual floatation device is configured to be worn in a waist belt.

11. The inflatable personal floatation system of claim 1, wherein said breakaway tether is permanently connected inside said sealed pouch.

12. The inflatable personal floatation system of claim 10, wherein said u-shaped bladder is not permanently fixed to said waist belt.

13. The inflatable personal floatation system of claim 9, wherein said individual floatation device comprises said u-shaped bladder.

14. The inflatable personal floatation system of claim 13, wherein said u-shaped bladder is manually inflatable by an inflation canister.

15. The inflatable personal floatation system of claim 14, wherein said inflation canister comprises a user activated carbon dioxide cylinder.

16. The inflatable personal floatation system of claim 10, wherein said sealed pouch is connected to an inside portion of said individual floatation device pack via said strap.

17. The inflatable personal floatation system of claim 1, wherein said individual floatation device is substantially planar.

18. The inflatable personal floatation system of claim 1, wherein said individual floatation device is operational within a temperature range of −40 to 140 degrees Fahrenheit.

19. The inflatable personal floatation system of claim 1, wherein said pack breakaway tether comprises a hook and loop fastener for separation from said sealed pouch.

20. An inflatable personal floatation system comprising:
an individual floatation device having;
arm-strap loops;
an inflation pull cord;
a pack breakaway tether; and
an inflation canister;
a sealed pouch;
an individual floatation device pack; and
a strap;
wherein said inflatable personal floatation system comprises said individual floatation device, said sealed pouch, said individual floatation device pack, and said strap structured and arranged in functional combination;
wherein said individual floatation device comprises said arm-strap loops, said inflation pull cord, said pack breakaway tether, and said inflation canister;
wherein said individual floatation device comprises a substantially u-shaped device;
wherein said individual floatation device is configured as a detachable u-shaped bladder housed in said sealed pouch within said individual floatation device pack;
wherein said individual floatation device pack is configured to be worn by a user;
wherein said individual floatation device is configured to be worn in a waist belt;

wherein said individual floatation device is housed within said sealed pouch and connected to said sealed pouch via said pack breakaway tether;

wherein said u-shaped bladder is not permanently fixed to said waist belt;

wherein said individual floatation device comprises said u-shaped bladder;

wherein said breakaway tether is permanently connected inside said sealed pouch;

wherein said sealed pouch is connected to an inside portion of said individual floatation device pack via said strap;

wherein said individual floatation device is manually inflatable;

wherein said u-shaped bladder is manually inflatable by an inflation canister;

wherein said inflation pull cord, when pulled, activates said inflation canister;

wherein said inflation canister comprises a user activated carbon dioxide cylinder;

wherein a carbon dioxide gas charge comprises 1 by 0.035 pounds;

wherein an inflated volume of said individual floatation device comprises a minimum of 970 cubic inches;

wherein an inflated buoyancy comprises a minimum of 35 pounds;

wherein said individual floatation device supports said user weighing a minimum of 35 pounds;

wherein said individual floatation device comprises urethane coated nylon;

wherein said individual floatation device comprises radio frequency heat sealed seams; and wherein said inflatable personal floatation system provides a safety device for said user.

* * * * *